US010226663B2

(12) United States Patent
Gomberg et al.

(10) Patent No.: US 10,226,663 B2
(45) Date of Patent: Mar. 12, 2019

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US); Nick T. Oblas, Malvern, PA (US); Sean P. Allison, York, PA (US); Michael Bissonnette, Denver, CO (US)

(73) Assignee: ROM3 REHAB LLC, Las Vegas, NV (US)

( * ) Notice: Subject to any disclaimer, the term of this patent is extended or adjusted under 35 U.S.C. 154(b) by 0 days.

(21) Appl. No.: 15/700,287

(22) Filed: Sep. 11, 2017

(65) Prior Publication Data

US 2018/0071569 A1 Mar. 15, 2018

Related U.S. Application Data

(60) Provisional application No. 62/393,348, filed on Sep. 12, 2016.

(51) Int. Cl.
*A63B 22/00* (2006.01)
*A63B 22/06* (2006.01)
(Continued)

(52) U.S. Cl.
CPC .... *A63B 22/0015* (2013.01); *A63B 21/00069* (2013.01); *A63B 21/015* (2013.01);
(Continued)

(58) Field of Classification Search
None
See application file for complete search history.

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 7628633 U1 12/1977
(Continued)

OTHER PUBLICATIONS

PCT International Search Report and Written Opinion, PCT/US17/50895 dated Jan. 12, 2018.
(Continued)

*Primary Examiner* — Stephen R Crow
(74) *Attorney, Agent, or Firm* — Luedeka Neely Group, PC

(57) ABSTRACT

An adjustable rehabilitation and exercise device, including a first rotary member rotatably mountable about a first hub and having a plurality of spaced apart and elongated first mount supports defined thereon; a first mount adjustably positioned on one of the first mount supports; a first patient engagement member attached to the first mount, a second rotary member rotatably mountable about a second hub the opposite the first rotary member, the second rotary member having a plurality of spaced apart and elongated second mount supports defined thereon; a second mount adjustably positioned on one of the second mount supports; and a second patient engagement member attached to the second mount. The first and second mounts are adjustably positionable on the first and second rotary members to enable adjustable positioning of the first and second patient engagement members radially relative to the first and second hubs of the rotary members and angularly relative to one another.

3 Claims, 31 Drawing Sheets

(51) Int. Cl.

| | |
|---|---|
| ***A63B 21/00*** | (2006.01) |
| ***A63B 21/015*** | (2006.01) |
| ***A63B 69/16*** | (2006.01) |
| *A63B 21/22* | (2006.01) |

(52) U.S. Cl.

CPC ..... *A63B 22/0002* (2013.01); *A63B 22/0046* (2013.01); *A63B 22/0605* (2013.01); *A63B 69/16* (2013.01); *A63B 21/225* (2013.01); *A63B 22/0005* (2015.10); *A63B 22/0007* (2013.01); *A63B 2022/0611* (2013.01); *A63B 2022/0623* (2013.01); *A63B 2022/0635* (2013.01); *A63B 2069/161* (2013.01); *A63B 2220/30* (2013.01); *A63B 2225/09* (2013.01)

(56) References Cited

U.S. PATENT DOCUMENTS

| | | | | |
|---|---|---|---|---|
| 446,671 | A | 2/1891 | Elliott | |
| 610,157 | A | 8/1898 | Campbell | |
| 631,276 | A | 8/1899 | Bulova | |
| 823,712 | A | 6/1906 | Uhlmann | |
| 1,149,029 | A | 8/1915 | Clark | |
| 1,227,743 | A | 5/1917 | Burgedorff | |
| 1,784,230 | A | 12/1930 | Freeman | |
| 3,081,645 | A | 3/1963 | Bergfors | |
| 3,100,640 | A | 8/1963 | Weitzel | |
| 3,137,014 | A | 6/1964 | Meucci | |
| 3,143,316 | A | 8/1964 | Shapiro | |
| 3,713,438 | A | 1/1973 | Knutsen | |
| 3,888,136 | A | 6/1975 | Lapeyre | |
| 4,079,957 | A | 3/1978 | Blease | |
| 4,446,753 | A | 5/1984 | Nagano | |
| 4,477,072 | A | 10/1984 | DeCloux | |
| 4,509,742 | A * | 4/1985 | Cones | A63B 22/001 138/45 |
| 4,606,241 | A | 8/1986 | Fredriksson | |
| 4,611,807 | A | 9/1986 | Castillo | |
| 4,648,287 | A | 3/1987 | Preskitt | |
| 4,673,178 | A | 6/1987 | Dwight | |
| 4,850,245 | A | 7/1989 | Feamster et al. | |
| 4,858,942 | A | 8/1989 | Rodriguez | |
| 4,915,374 | A | 4/1990 | Watkins | |
| 4,930,768 | A | 6/1990 | Lapcevic | |
| 4,961,570 | A | 10/1990 | Chang | |
| 5,027,794 | A | 7/1991 | Pyle | |
| 5,161,430 | A | 11/1992 | Febey | |
| 5,247,853 | A | 9/1993 | Dalebout | |
| D342,299 | S | 12/1993 | Birrell et al. | |
| 5,282,748 | A | 2/1994 | Little | |
| 5,316,532 | A | 5/1994 | Butler | |
| 5,324,241 | A | 6/1994 | Artigues et al. | |
| 5,336,147 | A | 8/1994 | Sweeney | |
| 5,338,272 | A | 8/1994 | Sweeney | |
| 5,361,649 | A | 11/1994 | Slocum | |
| 5,458,022 | A | 10/1995 | Mattfeld et al. | |
| 5,487,713 | A * | 1/1996 | Butler | A63B 71/0009 482/111 |
| 5,566,589 | A | 10/1996 | Buck | |
| 5,580,338 | A | 12/1996 | Scelta et al. | |
| 5,676,349 | A | 10/1997 | Wilson | |
| 5,685,804 | A | 11/1997 | Whan-Tong et al. | |
| 5,860,941 | A | 1/1999 | Saringer et al. | |
| 5,950,813 | A | 9/1999 | Hoskins et al. | |
| 6,053,847 | A | 4/2000 | Stearns et al. | |
| 6,077,201 | A | 6/2000 | Cheng | |
| 6,102,834 | A | 8/2000 | Chen | |
| 6,155,958 | A | 12/2000 | Goldberg | |
| 6,253,638 | B1 | 7/2001 | Bermudez | |
| 6,371,891 | B1 | 4/2002 | Speas | |
| 6,430,436 | B1 | 8/2002 | Richter | |
| 6,474,193 | B1 | 11/2002 | Farney | |
| 6,543,309 | B2 | 4/2003 | Heim | |
| 6,589,139 | B1 | 7/2003 | Butterworth | |
| 6,640,662 | B1 | 11/2003 | Baxter | |
| 6,820,517 | B1 | 11/2004 | Farney | |
| 6,865,969 | B2 | 3/2005 | Stevens | |
| 6,895,834 | B1 | 5/2005 | Baatz | |
| 7,226,394 | B2 | 6/2007 | Johnson | |
| 7,594,879 | B2 * | 9/2009 | Johnson | A63B 22/0002 482/57 |
| 9,044,630 | B1 | 6/2015 | Lampert et al. | |
| 9,480,873 | B2 | 11/2016 | Chuang | |
| 2003/0092536 | A1 | 5/2003 | Romanelli et al. | |
| 2004/0194572 | A1 | 10/2004 | Kim | |
| 2005/0020411 | A1 | 1/2005 | Andrews | |
| 2005/0085353 | A1 | 4/2005 | Johnson | |
| 2005/0274220 | A1 | 12/2005 | Reboullet | |
| 2006/0003871 | A1 | 1/2006 | Houghton et al. | |
| 2008/0161166 | A1 | 7/2008 | Lo | |
| 2009/0211395 | A1 | 8/2009 | Mul'e | |
| 2012/0167709 | A1 | 7/2012 | Chen et al. | |
| 2017/0113092 | A1 | 4/2017 | Johnson | |

FOREIGN PATENT DOCUMENTS

| | | | |
|---|---|---|---|
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A3 | 4/2001 |
| EP | 95019 | | 1/1897 |
| EP | 0199600 | A2 | 10/1986 |
| EP | 0634319 | B1 | 10/1999 |
| EP | 1034817 | A1 | 9/2000 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

OTHER PUBLICATIONS

Stephen R. Crow, Authorized Officer, PCT Notification of Transmittal of International Preliminary Report on Patentability, dated Dec. 11, 2018, PCT/US17/50895, Alexandria, Virginia USA.

* cited by examiner

ADJUSTABLE REHABILITATION AND EXERCISE DEVICE

CROSS-REFERENCE TO RELATED APPLICATION

This application claims priority to U.S. Provisional Application No. 62/393,348 filed Sep. 12, 2016, entitled ADJUSTABLE REHABILITATION AND EXERCISE DEVICE, incorporated herein by reference in its entirety.

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable relative to one another have been proposed. However, such designs require improvement due to the fact that the pedals tend to not remain securely mounted and detach, wobble and the like. In addition, it is desirable to provide for an adjustable rehabilitation or exercise device that is capable of providing both powered motion or user initiated motion without the need for separate devices.

Accordingly, in one aspect, the disclosure provides an adjustable rehabilitation and exercise device having patient engagement members on opposite sides of a rotary member. The patient engagement members are adjustably positionable radially and angularly.

SUMMARY

The disclosure provides adjustable rehabilitation and exercise devices.

In one aspect, an adjustable rehabilitation and exercise device includes a first rotary member rotatably mountable about a first hub and having a plurality of spaced apart and elongated first mount supports defined thereon; a first mount adjustably positioned on one of the first mount supports; a first patient engagement member attached to the first mount, a second rotary member rotatably mountable about a second hub the opposite the first rotary member, the second rotary member having a plurality of spaced apart and elongated second mount supports defined thereon; a second mount adjustably positioned on one of the second mount supports; and a second patient engagement member attached to the second mount.

The first and second mounts are adjustably positionable on the first and second rotary members to enable adjustable positioning of the first and second patient engagement members radially relative to the first and second hubs of the rotary members and angularly relative to one another.

In another aspect, an adjustable rehabilitation and exercise device includes a rotary member rotatably mountable about a hub and having a plurality of spaced apart and elongated first mount supports defined on a first side thereof and a plurality of spaced apart and elongated second mount supports defined on an opposite second side thereof; a first mount adjustably positioned on one of the first mount supports; a first patient engagement member attached to the first mount; a second mount adjustably positioned on one of the second mount supports; and a second patient engagement member attached to the second mount.

The first and second mounts are positionable relative to one another on the rotary member to enable adjustable positioning of the first and second patient engagement members radially relative to the hub and angularly relative to one another.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
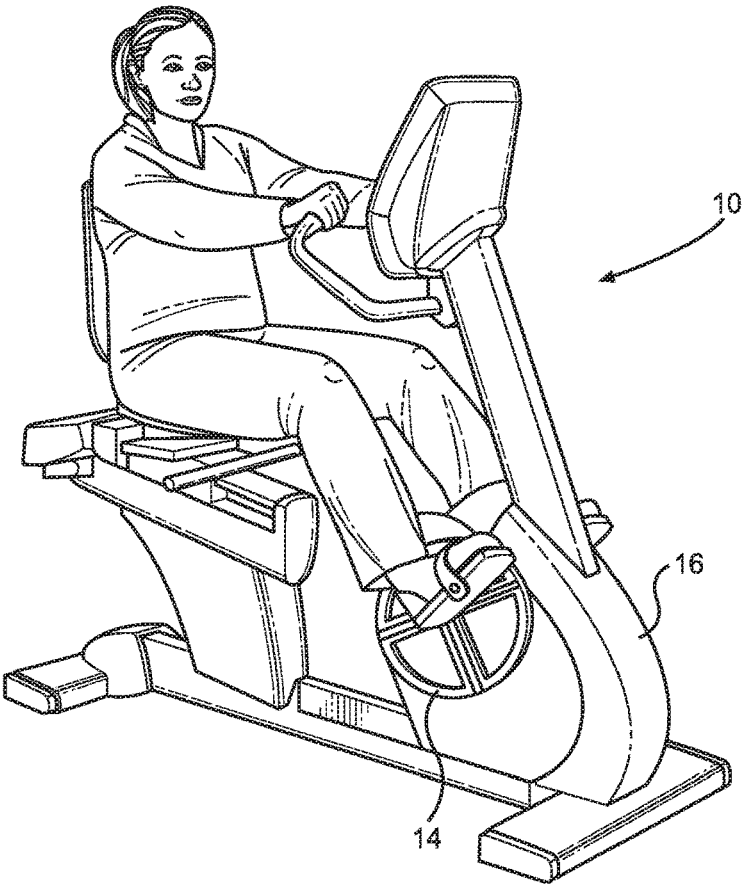
FIGS. 1A and 1B are perspective views of an adjustable rehabilitation and exercise device according to the disclosure configured to have adjustably positionable patient engagement members.
Figure 1B:
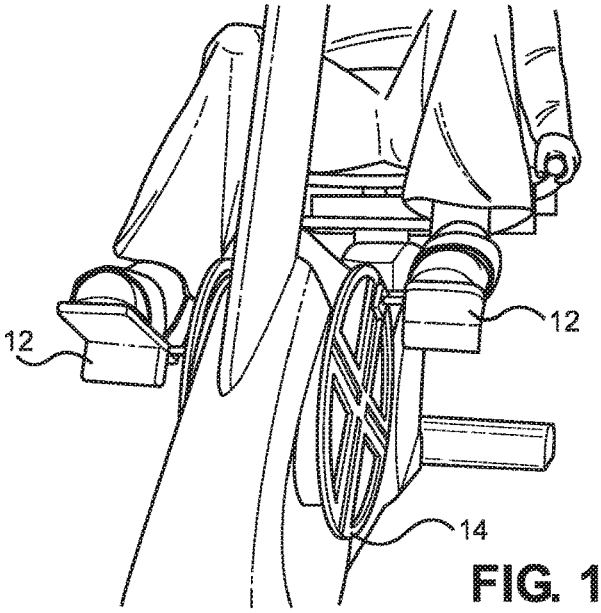
Figure 2A:
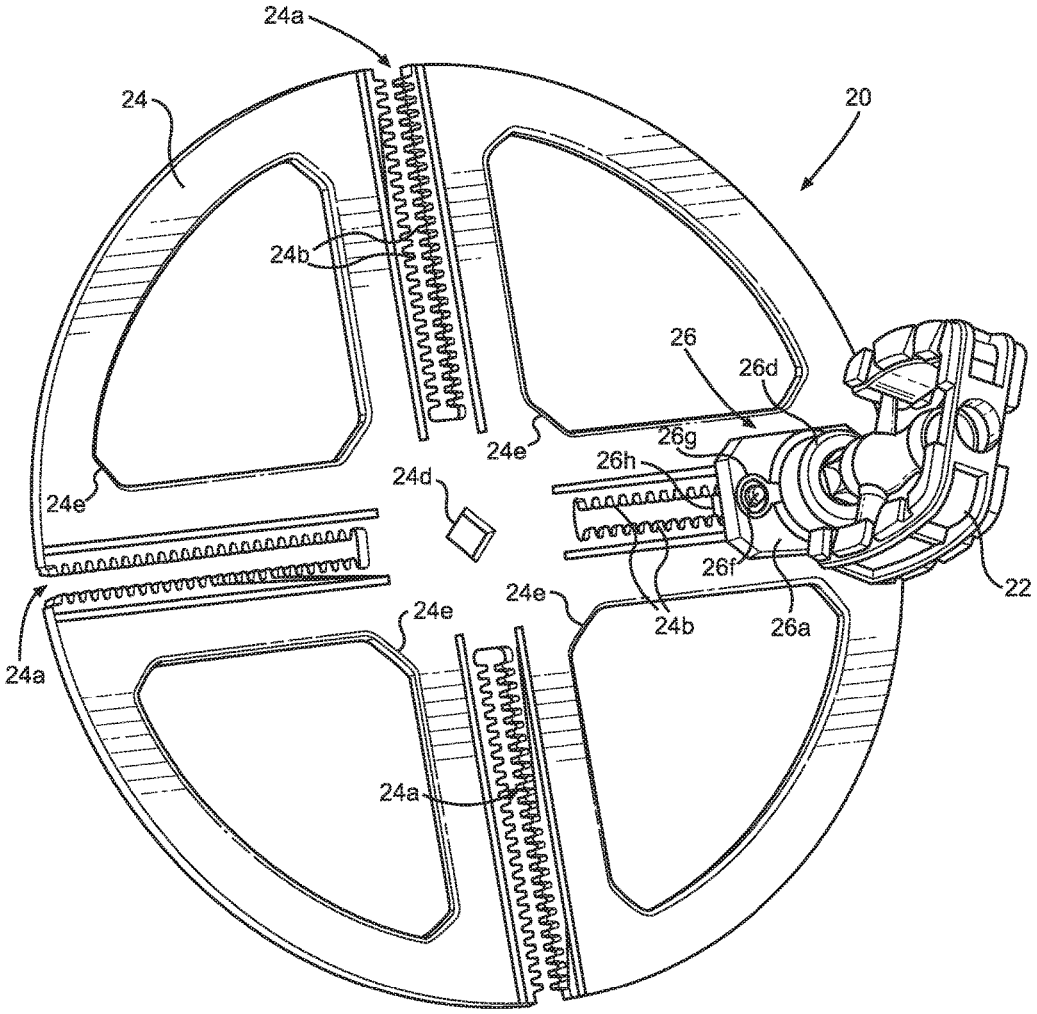
FIGS. 2A-2D show a wheel system for adjustably positioning a patient engagement member.
Figure 2B:
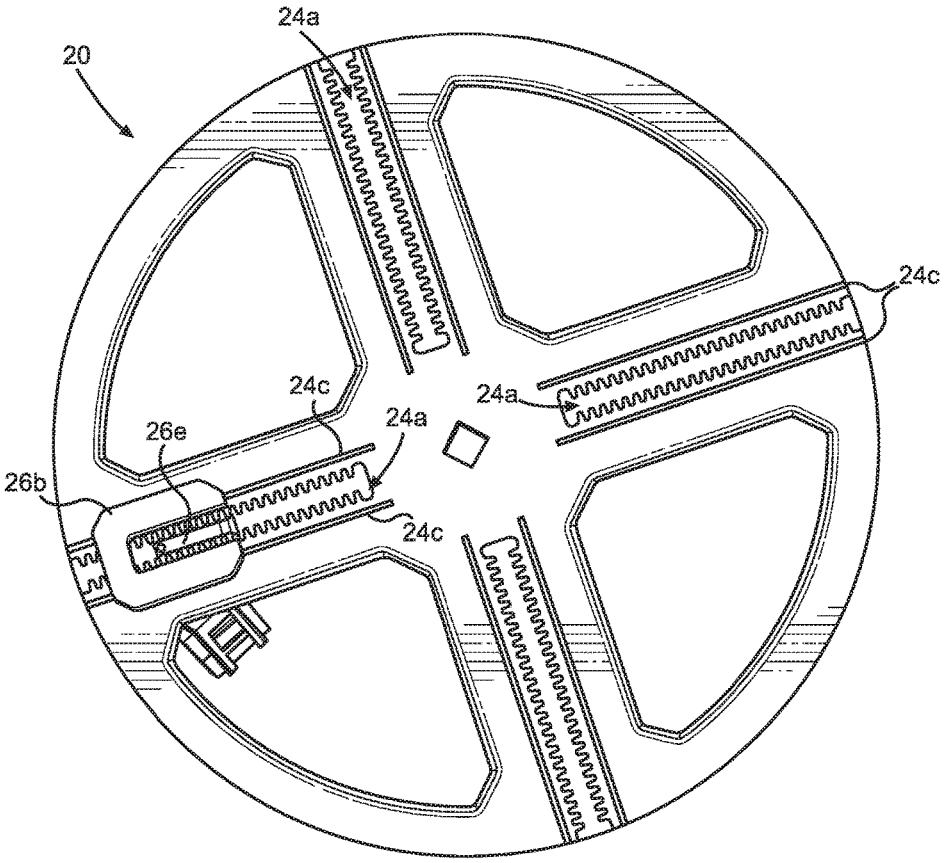
Figure 2C:
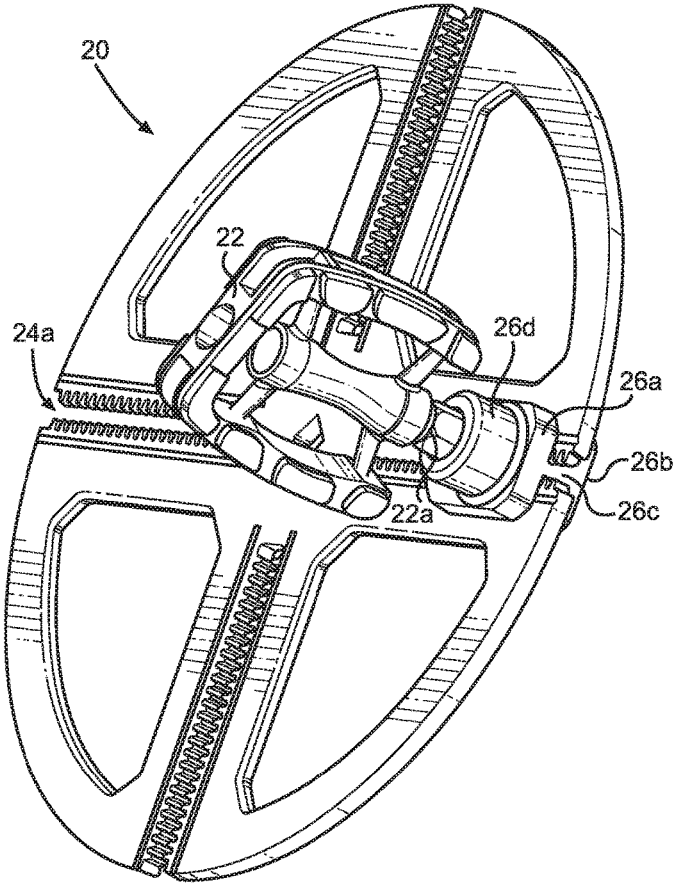
Figure 2D:
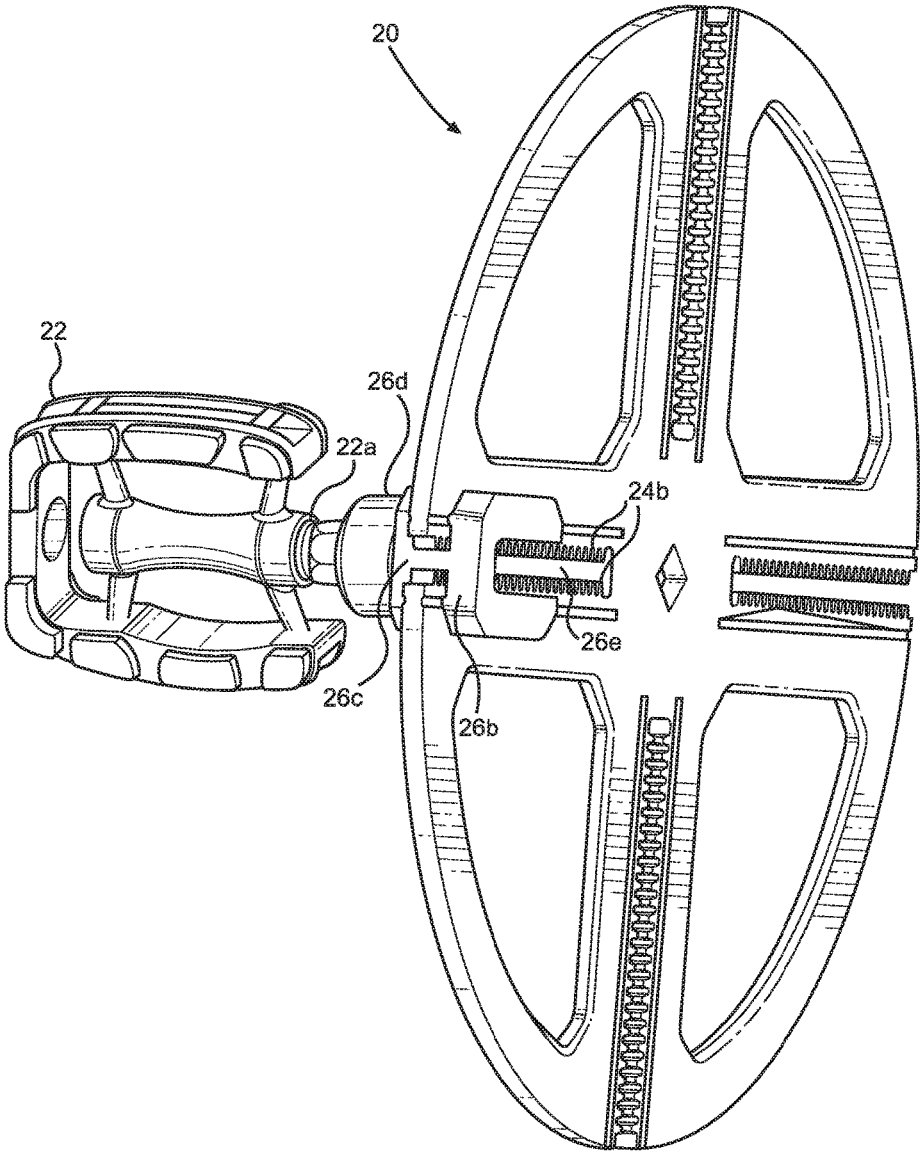
Figure 3A:
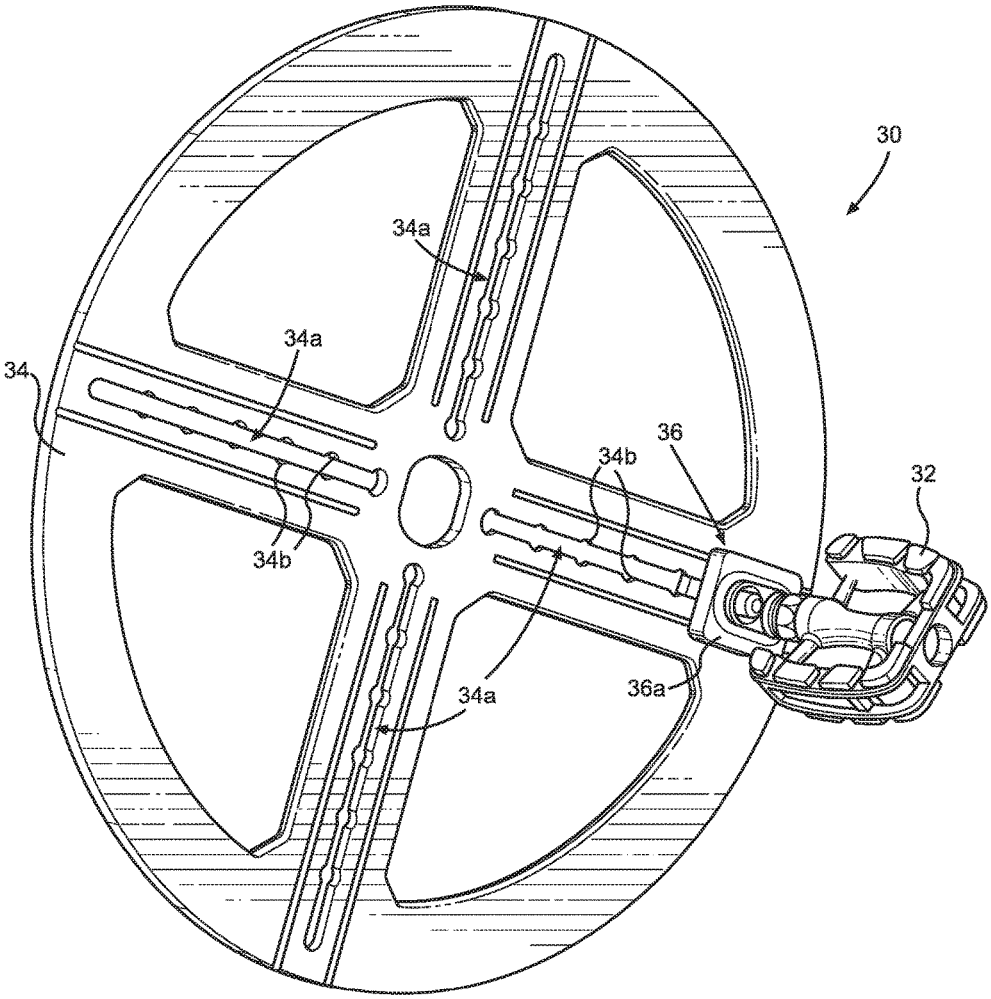
FIGS. 3A-3E show a second embodiment of a wheel system for adjustably positioning a patient engagement member.
Figure 3B:
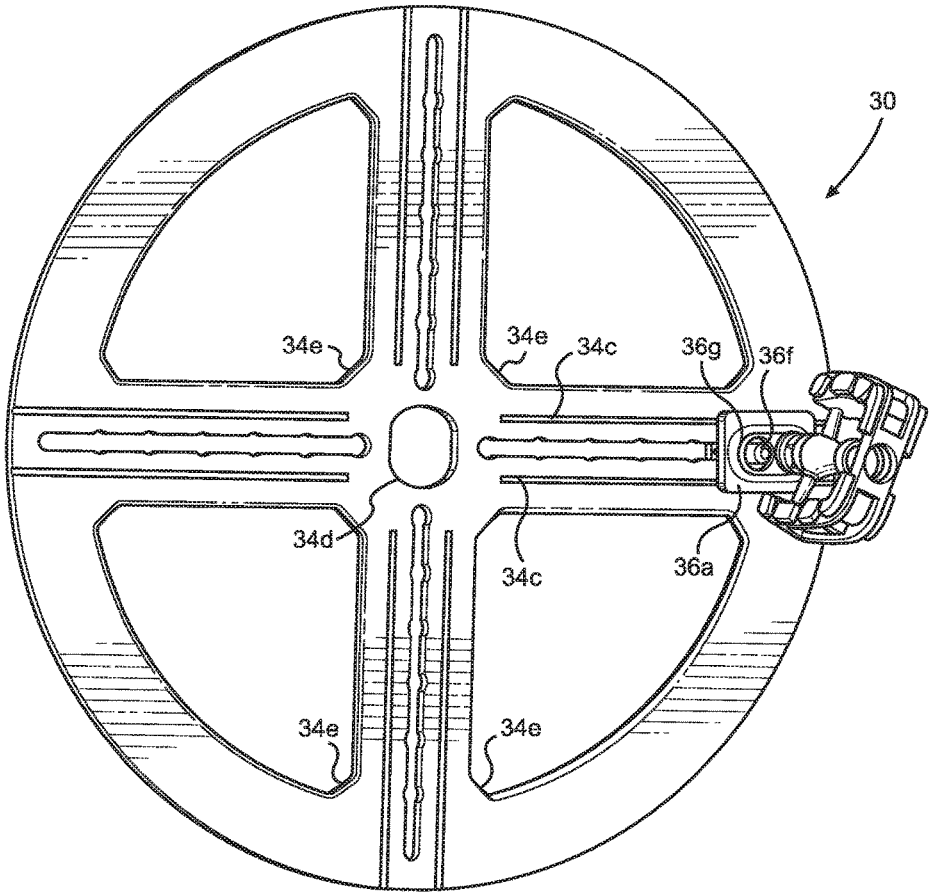
Figure 3C:
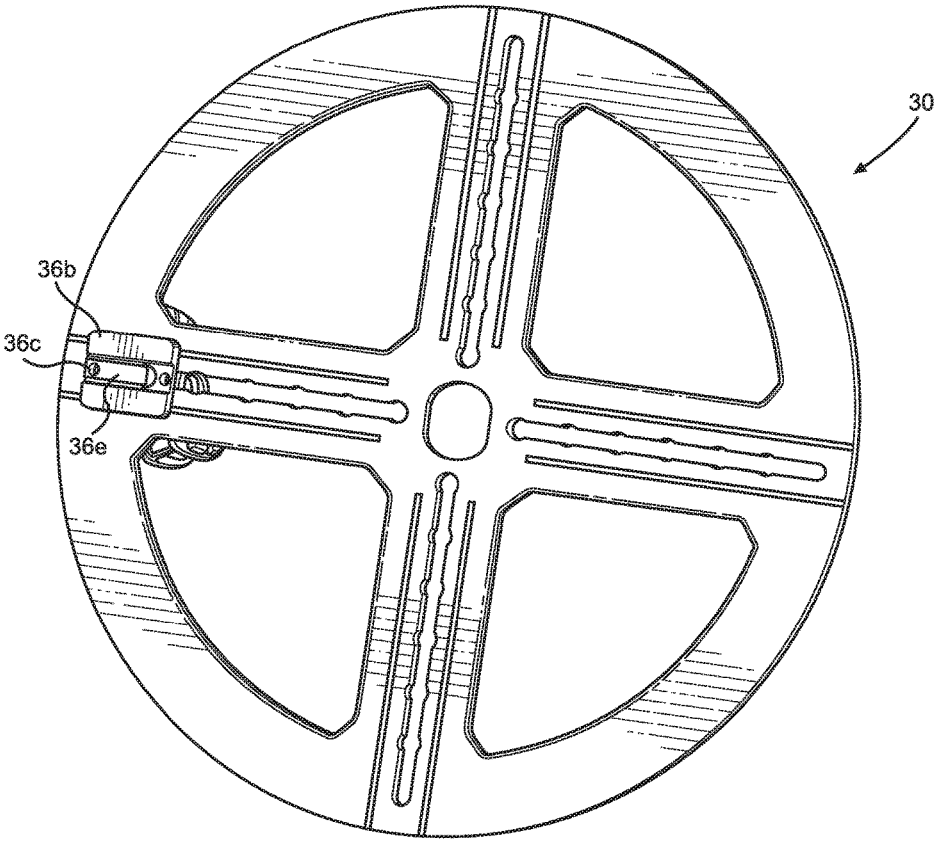
Figure 3D:
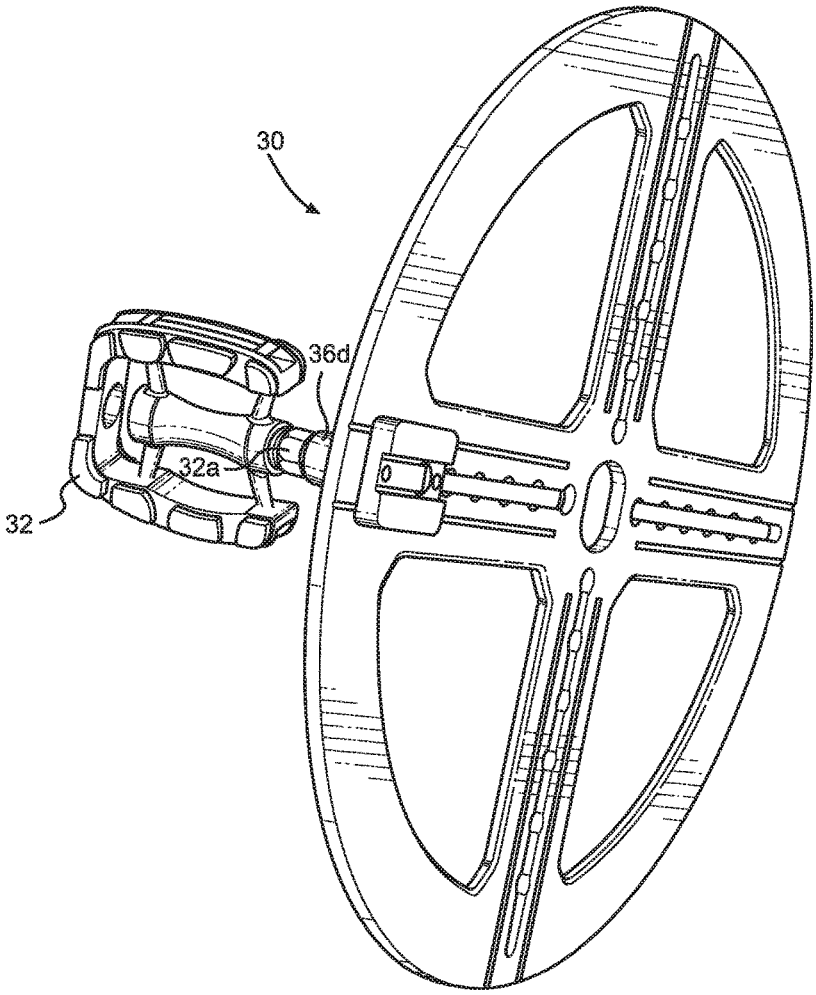
Figure 3E:
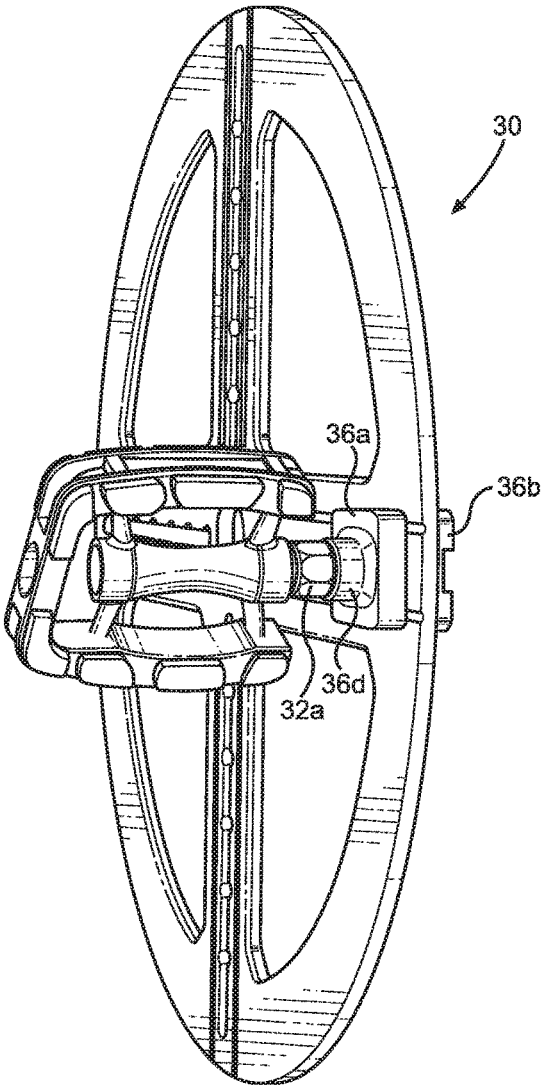
Figure 4A:
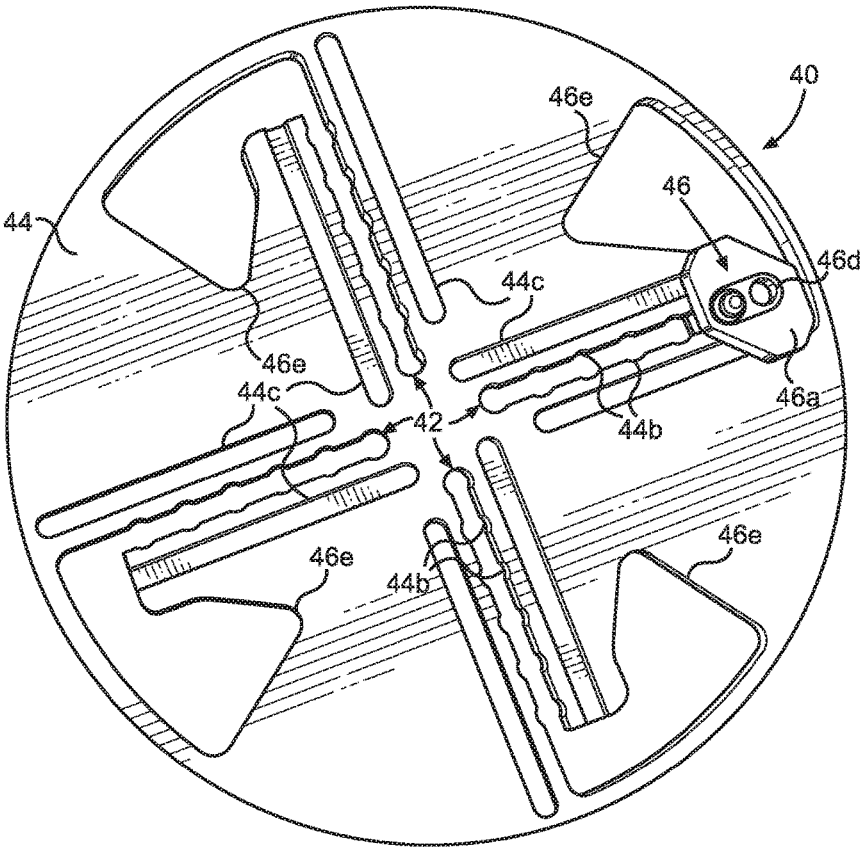
FIGS. 4A-4E, show a third embodiment of a wheel system for adjustably positioning a patient engagement member.
Figure 4B:
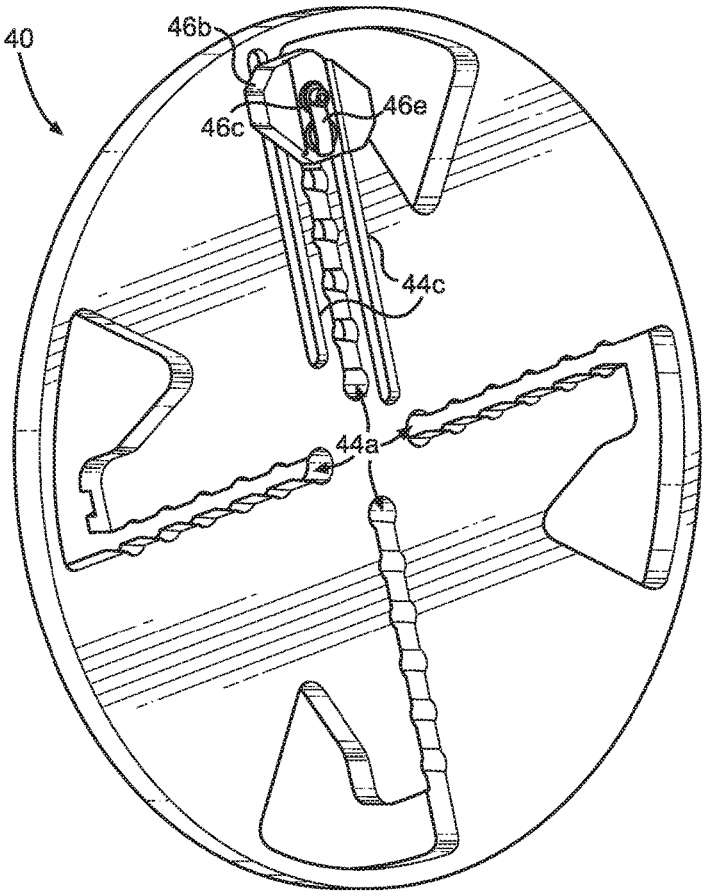
Figure 4C:
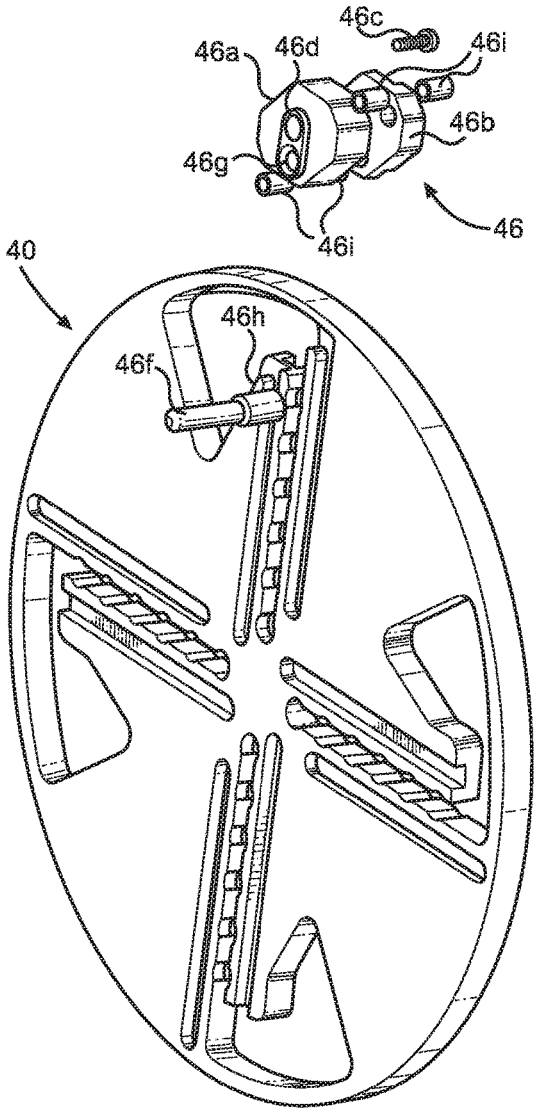
Figure 4D:
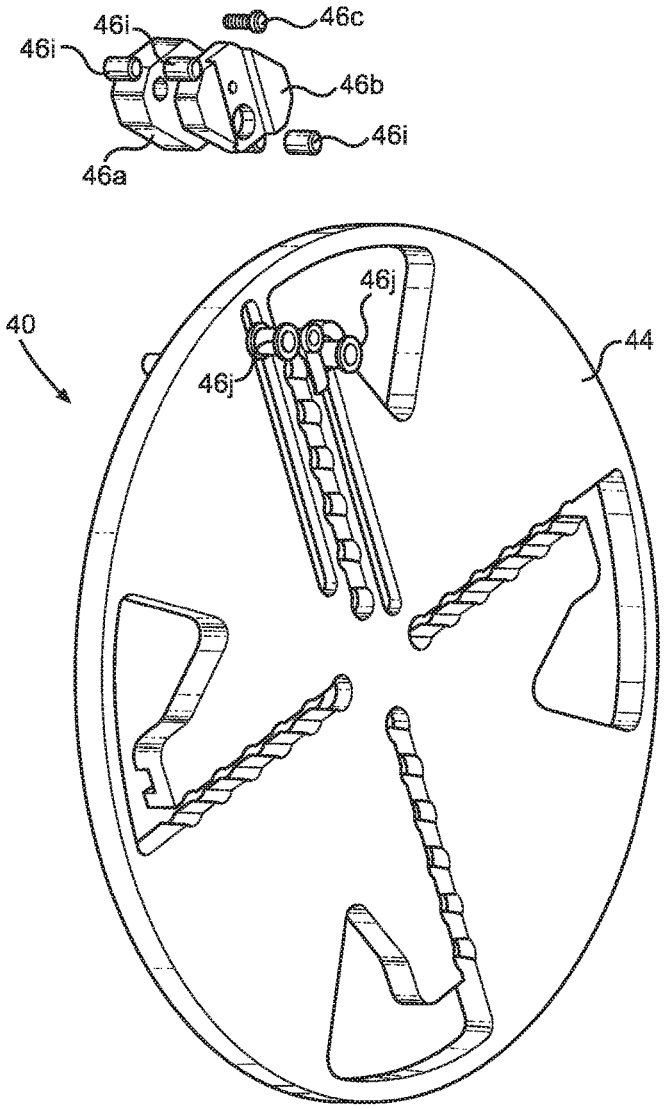
Figure 4E:
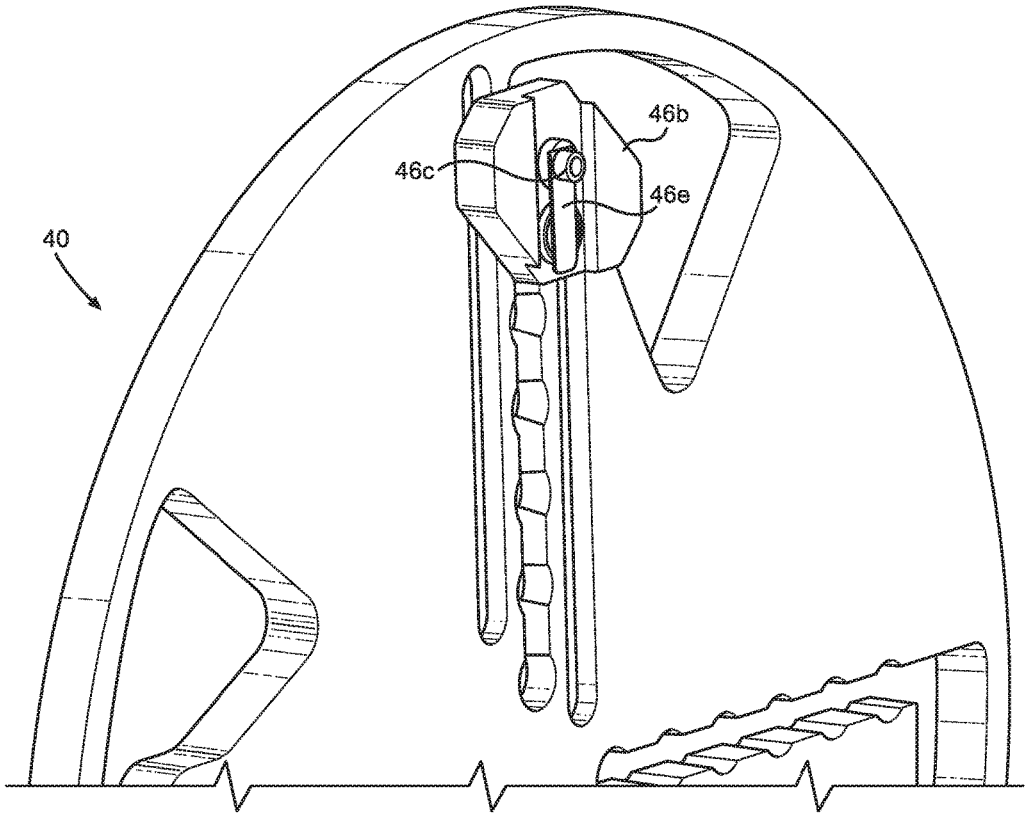
Figure 5A:
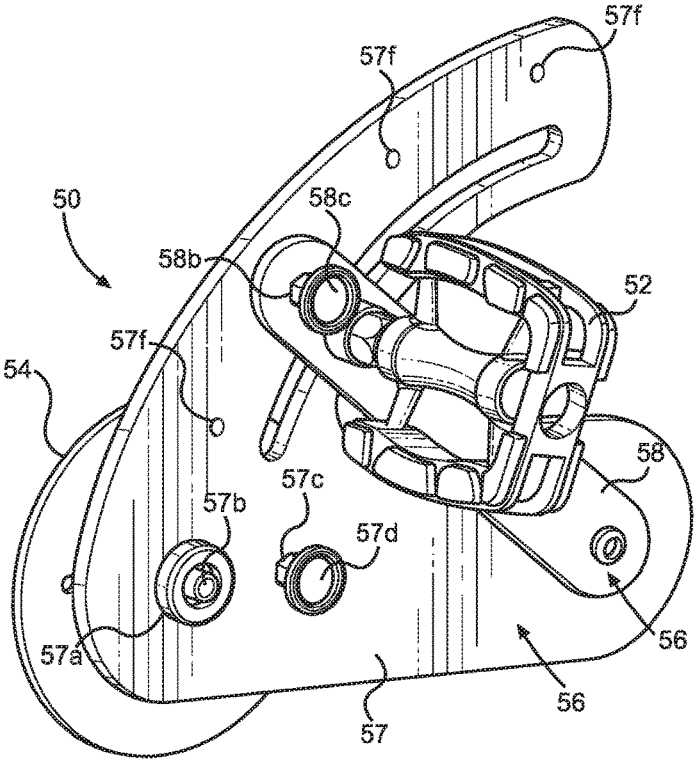
FIGS. 5A-5D, shows a fourth embodiment of a wheel system for adjustably positioning a patient engagement member.
Figure 5B:
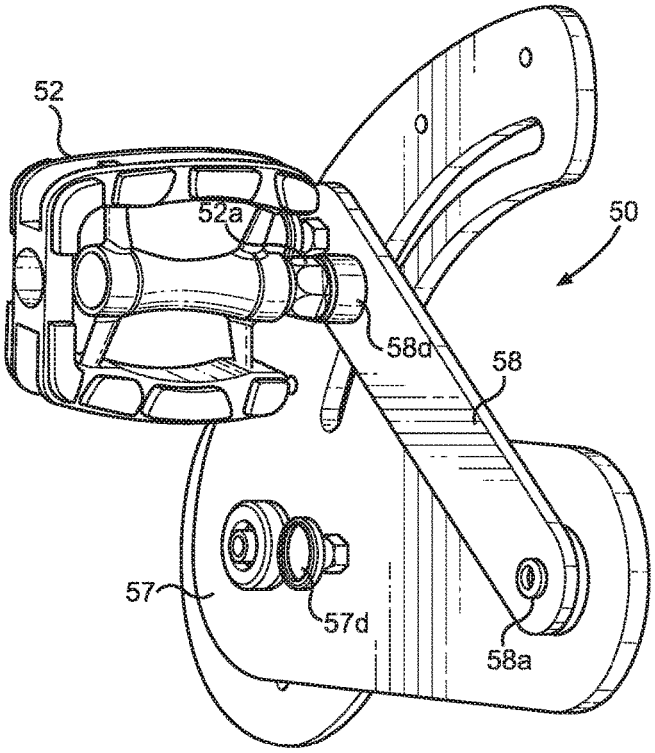
Figure 5C:
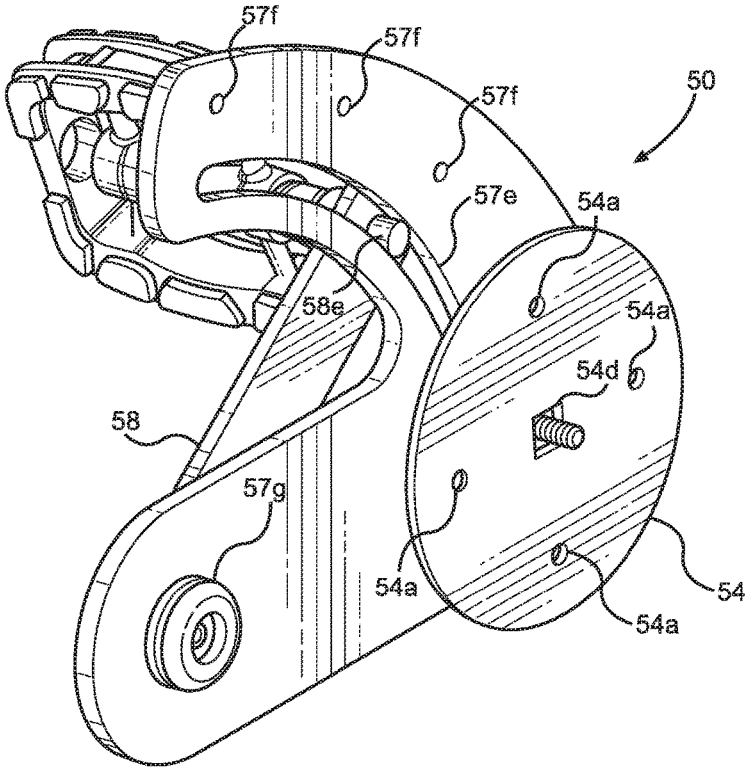
Figure 5D:
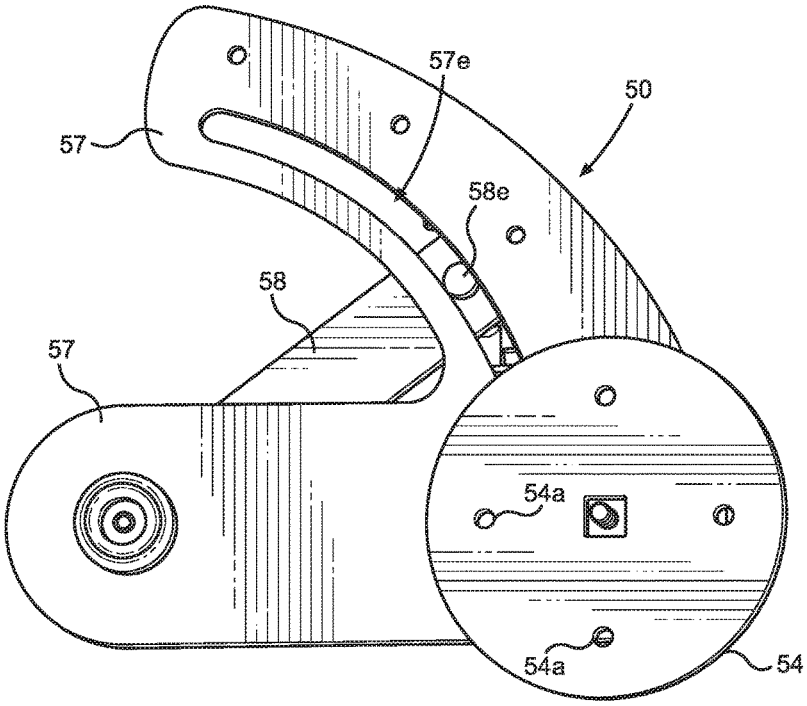

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a hub to a frame 16 or other support. The pedal 12 is configured for interacting with a patient to be rehabilitated and may be configured for use with lower body extremities such as the feet, legs, or upper body extremities such as the hands, arms, and the like. For example, the pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

A significant aspect of the disclosure relates to the structures described herein that enable and facilitate relative adjustment of a pair of patient engagement members. The disclosure provides show various configurations for wheel structures according to the disclosure to advantageously enable the patient engagement members, such as pedals, to be radially and angularly adjustable relative to one another on opposite sides of an exercise device, such as the device 10.

The drawings sets of FIGS. 2A-2D, 3A-3E, 4A-4E, 5A-5D, 6A-6C, 7A-7D, FIGS. 8A-8C, FIGS. 9A-9C show alternate embodiments of systems that enable and facilitate relative adjustment of a pair of patient engagement members and that are suitable for use with exercise and rehabilitations devices, such as the device 10

With reference to FIGS. 2A-2D, there is shown a wheel system 20 having a patient engagement member, such as a pedal 22 adjustably mounted on a wheel 24 by an adjustable mount 26. It will be appreciated that the patient engagement member may be configured to engage a hand or foot or other member of a patient as may be desired for rehabilitation. The pedal 22 may be a conventional pedal and includes a support rotatably mounted on an axle 22*a*. The axle 22*a* has exposed threads for being received by a corresponding threaded aperture of the mount 26. It will be appreciated that a pair of the wheels 24 may be utilized or, alternatively, a single one of the wheels 24 with a mount and pedal on each side.

The wheel 24 is a disk configured to include a plurality of spaced apart elongated slots 24*a* that extend through the thickness of the wheel 24. The slots 24*a* include a plurality of uniformly spaced teeth or cogs 24*b* along both sides of the length of the slots 24*a*. Raised ribs 24*c* are located on opposite sides of a rear surface of the slots 24*a* for cooperating with the mount 26.

The wheel 24 also includes a hub or central mounting aperture 24*d* for rotatably mounting of the wheel 24, such as to the device 10. Material of the wheel 24 may be removed to provide openings 24*e* to provide aesthetics and for reducing the weight and the cost of the wheel 24.

The mount 26 is I-shaped and includes a front plate 26*a* and a rear plate 26*b* connected by a center portion 26*c*. The axle 22*a* connects to a receiver 26*e* of the front plate 26*a*. A spring 26*e* is located on the rear plate 26*b* to urge a pin 26*f* toward the front plate 26*a*. The pin 26*f* extends between the spring 26*e* and the front plate 26*a*, with a tip of the pin 26*f* extending through an aperture 26*g* of the front plate 26*a*. The pin 26*f* has an enlarged head 26*h* that rests against the spring 26*e* and seats in the cogs 24*b* of the slot 24 to lock the position of the mount 26 relative to the slot 24.

The mount 26 is configured to stably locate the pedal 22 or other patient engagement member and eliminate wobble and the like associated with conventional devices. In addition, the mount 26 is also configured to advantageously enable substantially incremental adjustment of the position of the mount 26. The pin 26*f* and the spring 26*e* cooperate with the slot 24*a* to provide a lock for the mount 26 to lock the position of the mount 26 relative to the slot 24*a*. By a user pressing on the tip of the pin 26*f*, which thus serves in the manner of a push button, the pressure of the spring may be overcome to disengage the head of the pin 26*f* from the cogs 24*b* and enable the mount 26 to be moved relative to the slot 24*b*. In this manner, the location of the mount 26 may be incrementally adjusted along the slot 24.

Accordingly, it will be appreciated that the mount 26 cooperates with the slot 24*a* to adjustably position the mount 26, and hence the pedal 22, relative to the wheel 24. Further, the availability of a plurality of slots 24*a* enables a user to select which slot 24*a* for installation of the mount. Thus, in combination, the mount 26 and the slots 24*a* enable radial and angular adjustment of the position of the pedal 22. When this manner of adjustment is used for both of the pedals 22 on opposite sides of the device 10, it will be appreciated that the pedals 22, or other patient engagement members, may be adjustably positioned relative to one another angularly, with each pedal being radially adjustable relative to the hubs of the wheels.

With reference to FIGS. 3A-3E, there is shown a wheel system 30 having a patient engagement member, such as a pedal 32 adjustably mounted on a wheel 34 by an adjustable mount 36.

The wheel 34 is a disk configured to include a plurality of spaced apart elongated slots 34*a* that extend through the thickness of the wheel 34. The slots 34*a* include a plurality of uniformly spaced arcs 34*b* along both sides of the length of the slots 34*a*. Raised ribs 34*c* are located on opposite sides of a rear surface of the slots 34*a* for cooperating with the mount 36.

The wheel 34 also includes a hub or central mounting aperture 34*d* for rotatably mounting of the wheel 34 to the device 10 or the like. Material of the wheel 34 may be removed to provide openings 34*e* to provide aesthetics and for reducing the weight and the cost of the wheel 34.

The mount 36 includes a front plate 36*a* and a rear plate 36*b* connected by a fastener 36*c* that extends though the slot 34*a*. The axle 32*a* connects to a receiver 36*e* of the front plate 36*a*. A spring 36*e* is located on the rear plate 36*b* by the fastener 36*c* and is located to urge a pin 36*f* toward the front plate 36*a*. The pin 36*f* extends between the spring 36*e* and the front plate 36*a*, with a tip of the pin 36*f* extending through an aperture 36*g* of the front plate 36*a*. The pin 36*f* has an enlarged head that rests against the spring 36*e* and seats in the arcs 34*b* of the slot 34 to lock the position of the mount 36 relative to the slot 34.

The mount 36 is configured to stably locate the pedal 32 or other patient engagement member and eliminate wobble and the like associated with conventional devices. The mount 36 also enables substantially incremental adjustment of the position of the mount. The pin 36*f* and the spring 36*e* cooperate with the slot 34*a* to provide a lock for the mount 36 to lock the position of the mount 36 relative to the slot 34*a*. By a user pressing on the tip of the pin 36*f*, which thus serves in the manner of a push button, the pressure of the spring may be overcome to disengage the head of the pin 36*f* from the arcs 34*b* and enable the mount 36 to be moved relative to the slot 34*b*. In this manner, the location of the mount 36 may be incrementally adjusted along the slot 34.

The mount 36 cooperates with the slot 34*a* to adjustably position the mount 36, and hence the pedal 32, relative to the wheel 34. Further, the availability of a plurality of slots 34*a* enables a user to select which slot 34*a* for installation of the mount. Thus, in combination, the mount 36 and the slots 34*a* enable radial and angular adjustment of the position of the pedal 32. When this manner of adjustment is used for both of the pedals 32 on opposite sides of the device 10, it will be appreciated that the pedals 32, or other patient engagement members, may be adjustably positioned relative to one another angularly, with each pedal being radially adjustable relative to the hubs of the wheels.

With reference to FIGS. 4A-4E, there is shown a wheel system 40 configured to have a patient engagement member, such as a pedal adjustably mounted on a wheel 44 by an adjustable mount 46.

The wheel 44 is a disk configured to include a plurality of spaced apart elongated slots 44*a* that extend through the thickness of the wheel 44. The slots 44*a* include a plurality of uniformly spaced arcs 44*b* along both sides of the length of the slots 44*a*. Channels 44*c* extend through the wheel 44 adjacent the slots 44*a* for cooperating with the mount 46. For simplicity, only some of the channels 44*c* are shown in some of the views, it being understood that a set of the channels 44*c* will be provided in the same manner for each of the slots 44*a*.

The wheel 44 may also include a hub or central mounting aperture for rotatably mounting of the wheel 44, such as to the device 10. Material of the wheel 44 may be removed to provide openings 44*e* to provide aesthetics and for reducing the weight and the cost of the wheel 44.

The mount 46 includes a front plate 46*a* and a rear plate 46*b* connected by a fastener 46*c* that extends though the slot 44*a*. An axle of the patient engagement member connects to a receiver 46*e* of the front plate 46*a*. A spring 46*e* is located on the rear plate 46*b* by the fastener 46*c* and is located to urge a pin 46*f* toward the front plate 46*a*. The pin 46*f* extends between the spring 46*e* and the front plate 46*a*, with a tip of the pin 46*f* extending through an aperture 46*g* of the front plate 46*a*. The pin 46*f* has an enlarged head 46*h* that rests against the spring 46*e* and seats in the arcs 44*b* of the slot 44 to lock the position of the mount 46 relative to the slot 44. Pegs 46*i* are located to extend through the channels 44*c* and between the front plate 46*a* and the rear plate 46*b*, and ride within sleeves 46*j*.

The mount 46 is configured to stably locate a pedal or other patient engagement member and eliminate wobble and the like associated with conventional devices. The mount 46 also enables substantially incremental adjustment of the position of the mount. The pin 46*f* and the spring 46*e* cooperate with the slot 44*a* to provide a lock for the mount 46 to lock the position of the mount 46 relative to the slot 44*a*. By a user pressing on the tip of the pin 46*f*, which thus serves in the manner of a push button, the pressure of the spring may be overcome to disengage the head of the pin 46*f* from the arcs 44*b* and enable the mount 46 to be moved relative to the slot 44*b*. In this manner, the location of the mount 46 may be incrementally adjusted along the slot 44.

The mount 46 cooperates with the slot 44*a* to adjustably position the mount 46, and hence the pedal, relative to the wheel 44. Further, the availability of a plurality of slots 44*a* enables a user to select which slot 44*a* for installation of the mount. Thus, in combination, the mount 46 and the slots 44*a* enable radial and angular adjustment of the position of the pedal. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

With reference to FIGS. 5A-5D, there is shown a wheel system 50 having a patient engagement member, such as a pedal 52 adjustably mounted on a wheel 54 by an adjustable mount 56.

The pedal 52 may be a conventional pedal and includes a support rotatably mounted on an axle 52*a*. The axle 52*a* has exposed threads for being received by a corresponding threaded aperture of the mount 56

The wheel 54 is a disk configured to include a plurality of spaced apart apertures 54*a* that extend through the thickness of the wheel 54. The wheel 54 may also include a hub or central mounting aperture 54*d* for rotatable mounting of the wheel 54.

The mount 56 includes a plate 57 and an arm 58. The plate 57 includes a central wheel aperture 57*a* aligned with the central mounting aperture 54*d* of the wheel 54. A fastener 57*b* passes through the wheel aperture 57*a* and the central mounting aperture 54*d* for connecting the plate 57 to the wheel 54, and for connecting the wheel 54 to an exercise device. A plate adjustment aperture 57*c* is located to selectively align with the apertures 54*a* of the wheel 54. A spring-loaded pin 57*d* is provided to selectively pass through the plate adjustment aperture 57*c* and one of the apertures 54*a* to adjust the angle of the plate 57 relative to the wheel 54. The plate 57 also includes an elongated curved slot 57*e*, arm lock apertures 57*f*, and an arm receiver 57*g*.

The arm 58 includes a pivot mount 58*a*, a lock aperture 58*b*, lock pin 58*c*, receiver 58*d*, and a guide 58*e*. The pivot mount 58*a* may be provided as by an aperture that aligns with the arm receiver 57*g* of the plate 57, with a fastener or the like extending therethrough to pivotally connect the arm 58 to the plate 57. The receiver 58*d* is threaded to receive the threads of the axle 52*a* of the pedal 52 or other patient engagement member.

The mount 56 is configured to stably locate a pedal or other patient engagement member and eliminate wobble and the like associated with conventional devices. In addition, the mount 56 is also configured to advantageously enable substantially incremental adjustment of the position of the mount. The pin 57*d* cooperates with the apertures 54*a* to adjust and fix the position of the arm 57 relative to the wheel 54. Further, angle of the arm 58 relative to the plate 57 may be adjusted and fixed by use of the lock pin 58*c* and the arm lock apertures 57*f*. Thus, in combination, the adjustment of the plate 57 relative to the wheel 54 and the adjustment of the arm 58 relative to the plate 57 enables radial and angular adjustment of the position of the pedal 52. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

Figure 6A:
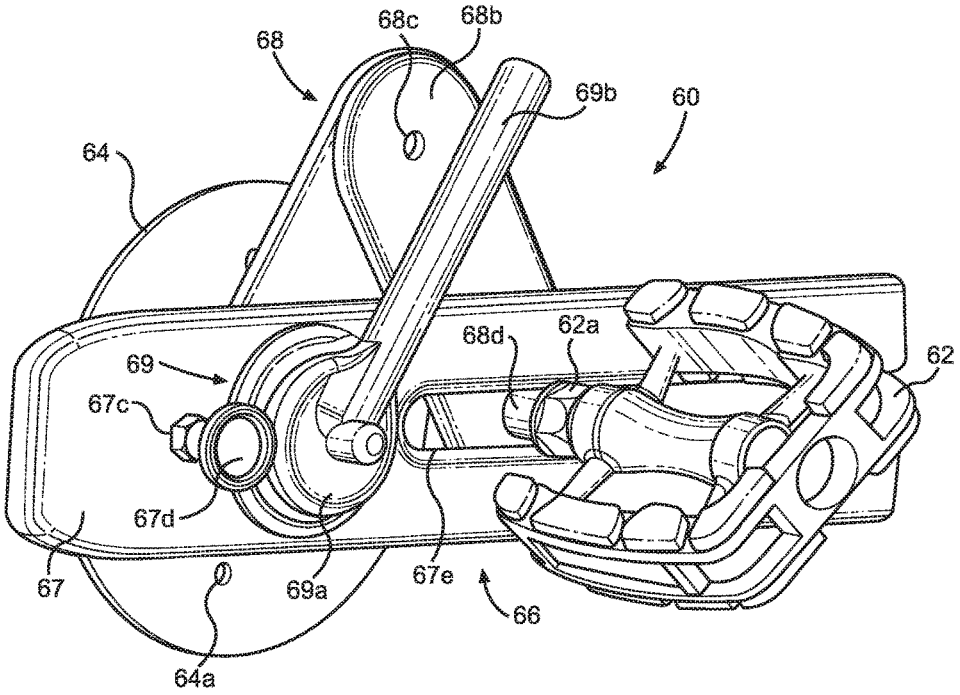
FIGS. 6A-6C, show a fifth embodiment of a wheel system for adjustably positioning a patient engagement member.
Figure 6B:
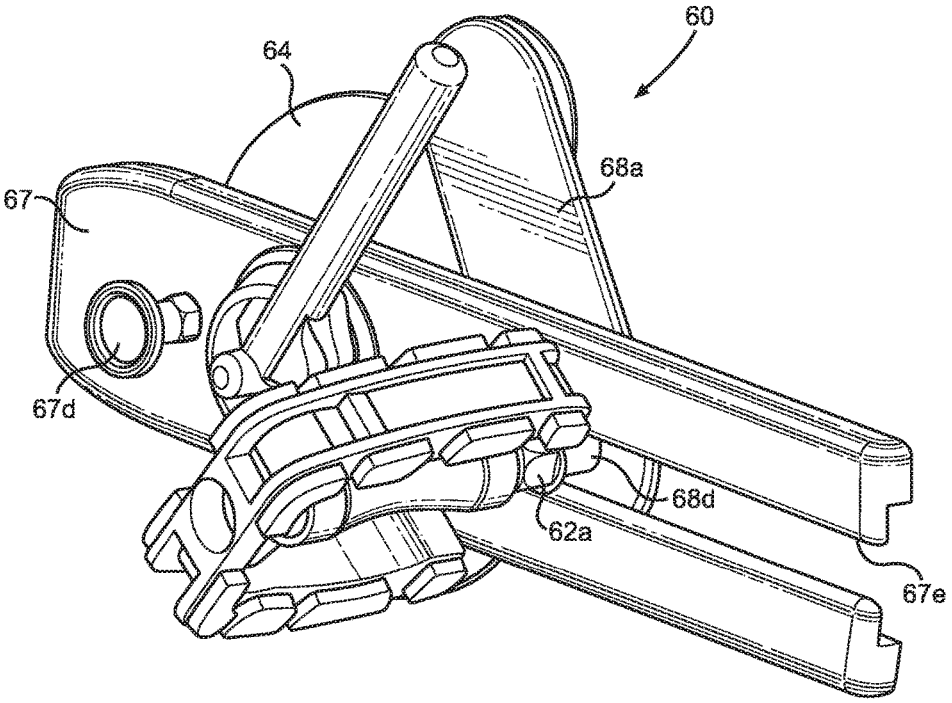
Figure 6C:
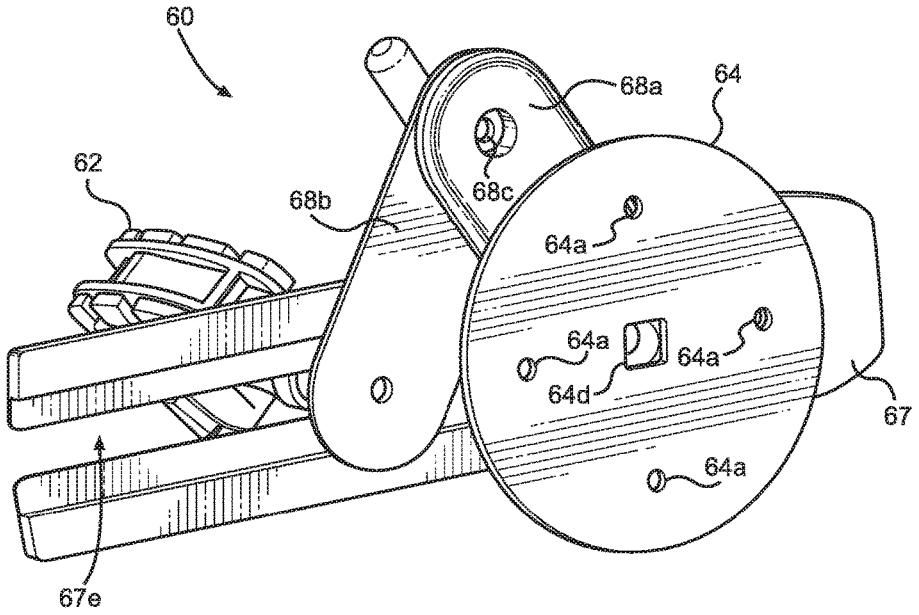
Figure 7A:
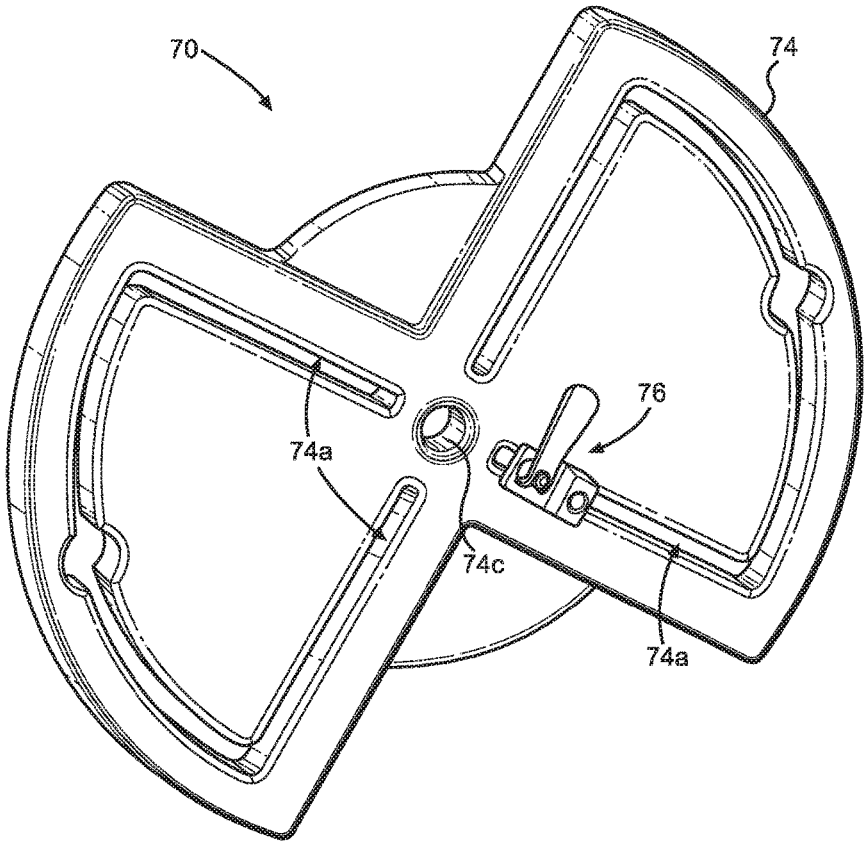
FIGS. 7A-7D, show a sixth embodiment of a wheel system for adjustably positioning a patient engagement member.
Figure 7B:
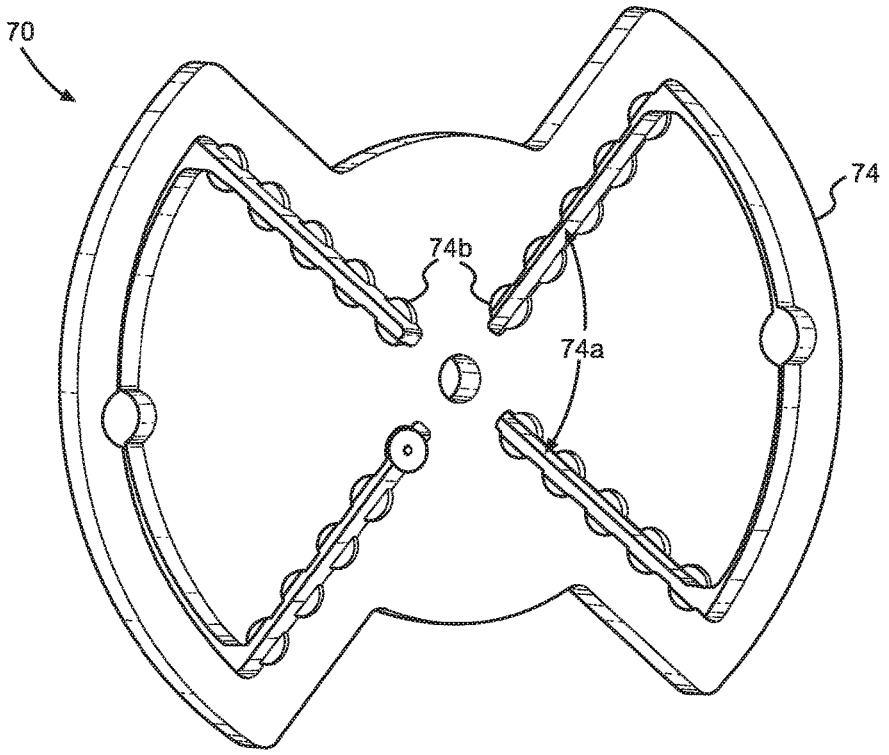
Figure 7C:
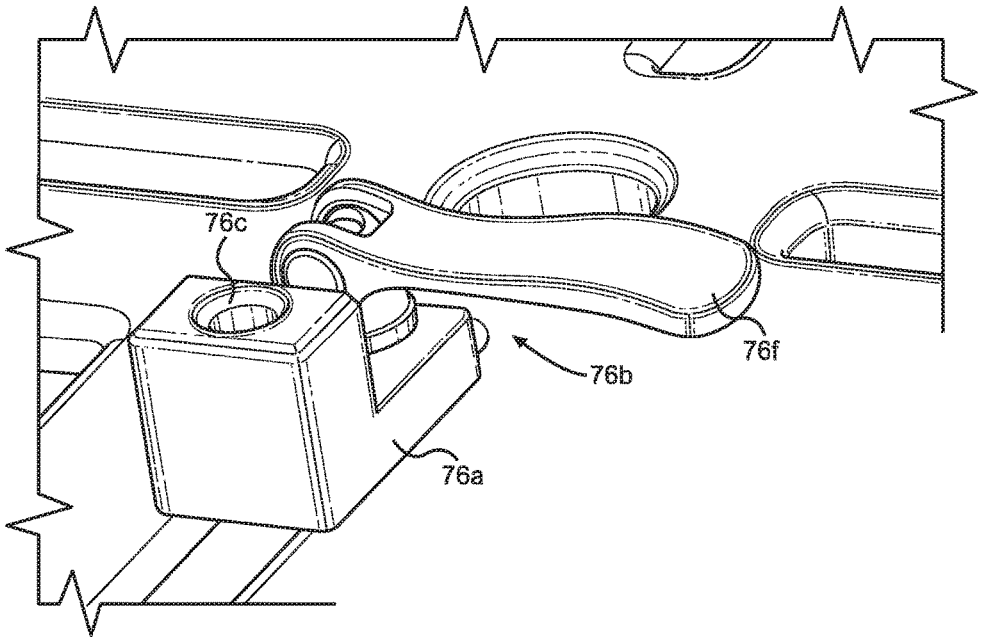
Figure 7D:
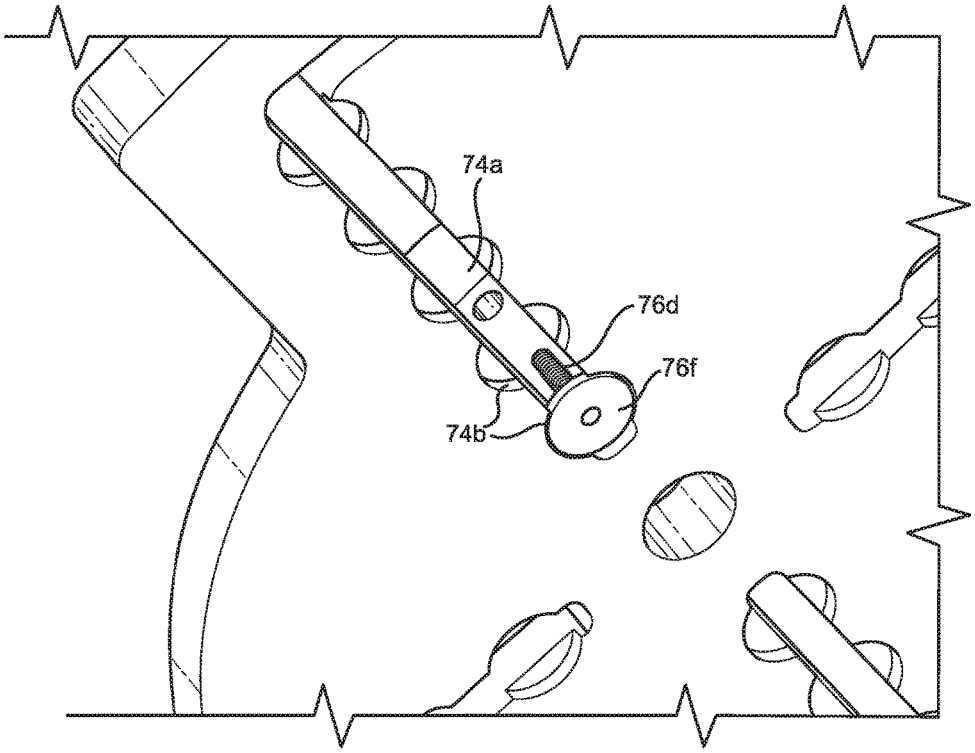

With reference to FIGS. 6A-6C, there is shown a wheel system 60 having a patient engagement member, such as a pedal 62 adjustably mounted on a wheel 64 by an adjustable mount 66.

The pedal 62 may be a conventional pedal and includes a support rotatably mounted on an axle 62*a*. The axle 62*a* has exposed threads for being received by a corresponding threaded aperture of the mount 56

The wheel 64 is a disk configured to include a plurality of spaced apart apertures 64*a* that extend through the thickness of the wheel 64. The wheel 64 may also include a hub or central mounting aperture 64*d* for rotatable mounting of the wheel 64.

The mount 66 includes a plate 67, an arm 68, and an arm lock 69. The plate 67 includes a wheel aperture aligned with the central mounting aperture 64*d* of the wheel 64, and over which the arm lock 69 is mounted. A plate adjustment aperture 67*c* is located to selectively align with the apertures 64*a* of the wheel 64. A spring-loaded pin 67*d* is provided to selectively pass through the plate adjustment aperture 67*c* and one of the apertures 64*a* to adjust the angle of the plate 67 relative to the wheel 64. The plate 67 also includes an elongated slot 67*e*.

The arm 68 includes a pair of arm members 68*a* and 68*b* pivotally mounted to one another at pivot 68*c*. The arm member 68*a* is connected to the wheel 64 via the arm lock 69 that includes a fastener or the like that extends through the central mounting aperture 64*d* and a corresponding aperture of the arm member 68*a* to further connect the wheel 64 to an exercise device. The arm member 68*b* includes a receiver 68*d* that extends through the slot 67*e* of the plate 67. The receiver 68*d* is threaded to receive the threads of the axle 62*a* of the pedal 62 or other patient engagement member.

The lock 69 includes a rotatable hub 69*a* and a lever arm 69*b* to facilitate desired rotation of the hub 69*a* to enable a sufficient locking force to be applied or removed by hand. A fastener associated with the hub 69*a* extends from the hub 69*a* through the central mounting aperture 64*d* and the corresponding aperture of the arm member 68*a* to connect the wheel 64 to a hub or like of the device 10. By rotating the hub 69*a* using the lever arm 69*b*, the fastener may be rotated to tighten the hub 69*a* against the plate 67, arm 68, and the wheel 64. Likewise, the hub 69*a* may be loosened for adjusting the position of the plate 67 and arm 68.

The mount 66 is configured to stably locate a pedal or other patient engagement member and eliminate wobble and the like associated with conventional devices. The mount 66 also enables substantially incremental adjustment of the position of the mount. Adjustment of the plate 67 relative to the wheel 64 and the adjustment of the arm 68 relative to the plate 67 enables radial and angular adjustment of the position of the pedal 62. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

With reference to FIGS. 7A-7D, there is shown a wheel system 70 having a patient engagement member, such as a pedal adjustably mounted on a wheel 74 by an adjustable mount 76.

The wheel 74 includes a plurality of spaced apart elongated slots 74*a* that extend through the thickness of the wheel 74. The slots 74*a* include a plurality of uniformly spaced arcs 74*b* along both sides of the length of the slots 74*a*. The wheel 74 may also include a hub or central mounting aperture 74*c* for rotatable mounting of the wheel 74. Material of the wheel 74 may be removed to provide aesthetics and for reducing the weight and the cost of the wheel 74.

The mount 76 includes a sliding member 76*a* having a quick release 76*b* located thereon. The mount also includes a receiver 76*c* located on the sliding member 76*c* and configured to receive an axle of the pedal or other patient engagement member. The quick release 76*b* includes a rod 76*e* threaded on one end and a lever operated cam assembly on the other. The rod extends through the slot 74*a*, and a nut 76*e* is threaded on the opposite end and sized to engage the arcs 74*b*. A lever 76*f* of the cam assembly is closed to tighten the cam and lock the mount 76 in place.

The mount 76 is configured to stably locate a pedal or other patient engagement member and eliminate wobble and the like associated with conventional devices. The mount 76 also enables substantially incremental adjustment of the position of the mount. The pin 76*f* and the spring 76*e* cooperate with the slot 74*a* to provide a lock for the mount 76 to lock the position of the mount 76 relative to the slot 74*a*. By a user pressing on the tip of the pin 76*f*, which thus serves in the manner of a push button, the pressure of the spring may be overcome to disengage the head of the pin 76*f* from the arcs 74*b* and enable the mount 76 to be moved relative to the slot 74*b*. In this manner, the location of the mount 76 may be incrementally adjusted along the slot 74.

The mount 76 cooperates with the slot 74*a* to adjustably position the mount 76, and hence the pedal, relative to the wheel 74. Further, the availability of a plurality of slots 74*a* enables a user to select which slot 74*a* for installation of the mount. Thus, in combination, the mount 76 and the slots 74*a* enable radial and angular adjustment of the position of the pedal. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

Figure 8A:
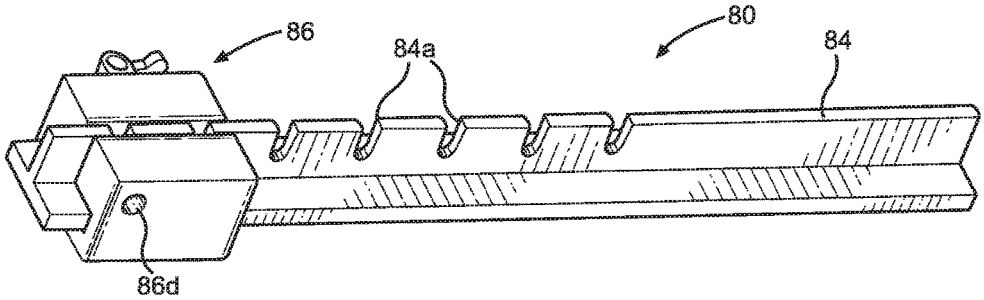
FIGS. 8A-8C, show a seventh embodiment of a wheel system for adjustably positioning a patient engagement member.
Figure 8B:
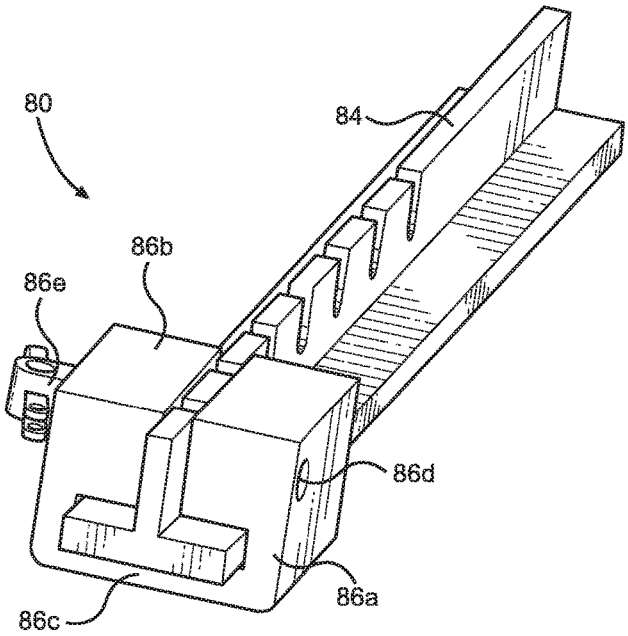
Figure 8C:
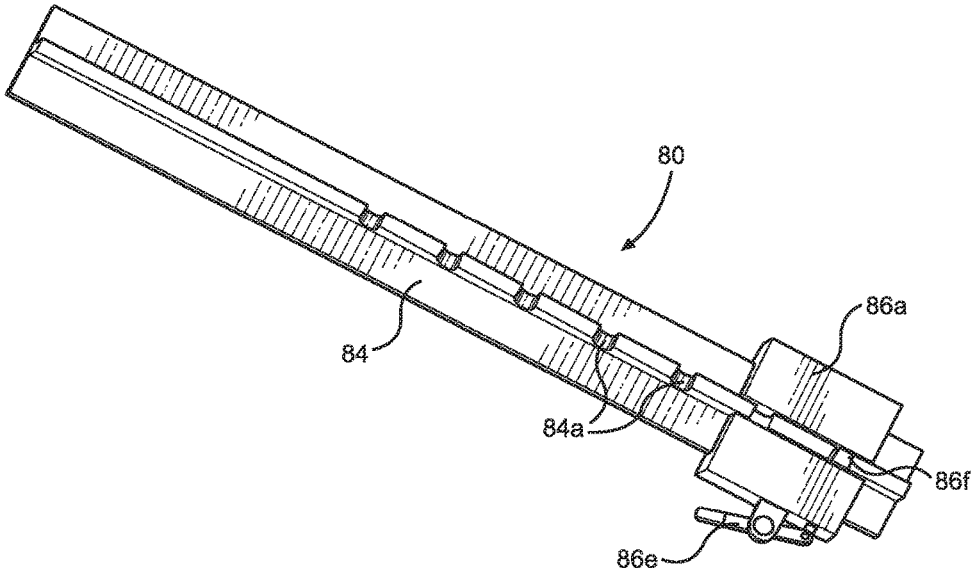

With reference to FIGS. 8A-8C, there is shown a system 80 having a support 84 with an adjustable mount 86 seated thereon for adjustably mounting a patient engagement member, such as a pedal, on the support 84.

The support 84 is an elongated T-shaped member having a plurality of uniformly spaced apart notches 84*a*. The support 84 is preferably one of a plurality of such supports for the system 80 provided on a wheel. In such case, the supports 84 are desirably located at spaced apart locations on the wheel.

The mount 86 is I-shaped and includes a front plate 86*a* and a rear plate 86*b* connected by a center portion 86*c*. A receiver 86*e* is located on the front plate 86*a* for mounting a patient engagement member, such as a pedal. A lever 86*e* is located on the rear plate 86*b* to position a pin 86*f* toward the front plate 86*a*. The pin 86*f* extends through aligned bores of the rear plate 86*b* and the front plate 86*a*. When the lever 86*e* is depressed, the pin 86*f* extends between the gap between the rear plate 86*b* and the front plate 86*a*, and passes through one of the notches 84*a* to lock the position of the mount 86. The lever 86*e* may be reversed to retract the pin 86*f* to permit the location of the mount 86 to be adjusted.

The mount 86 is configured to stably locate a pedal or other patient engagement member and eliminate wobble and the like associated with conventional devices. The mount 86 also enables substantially incremental adjustment of the position of the mount, and hence a patient engagement member, relative to a wheel. Further, the availability of a plurality of supports 84 on a wheel enables a user to select which support 84 for installation of the mount 86. Thus, the system 80 enables radial and angular adjustment of the position of a patient engagement member. When this manner of adjustment is used for locating patient engagement members on opposite sides of the device 10, it will be appreciated that the patient engagement members, may be adjustably positioned relative to one another angularly, with each pedal being radially adjustable relative to the hubs of the wheels.

Figure 9A:
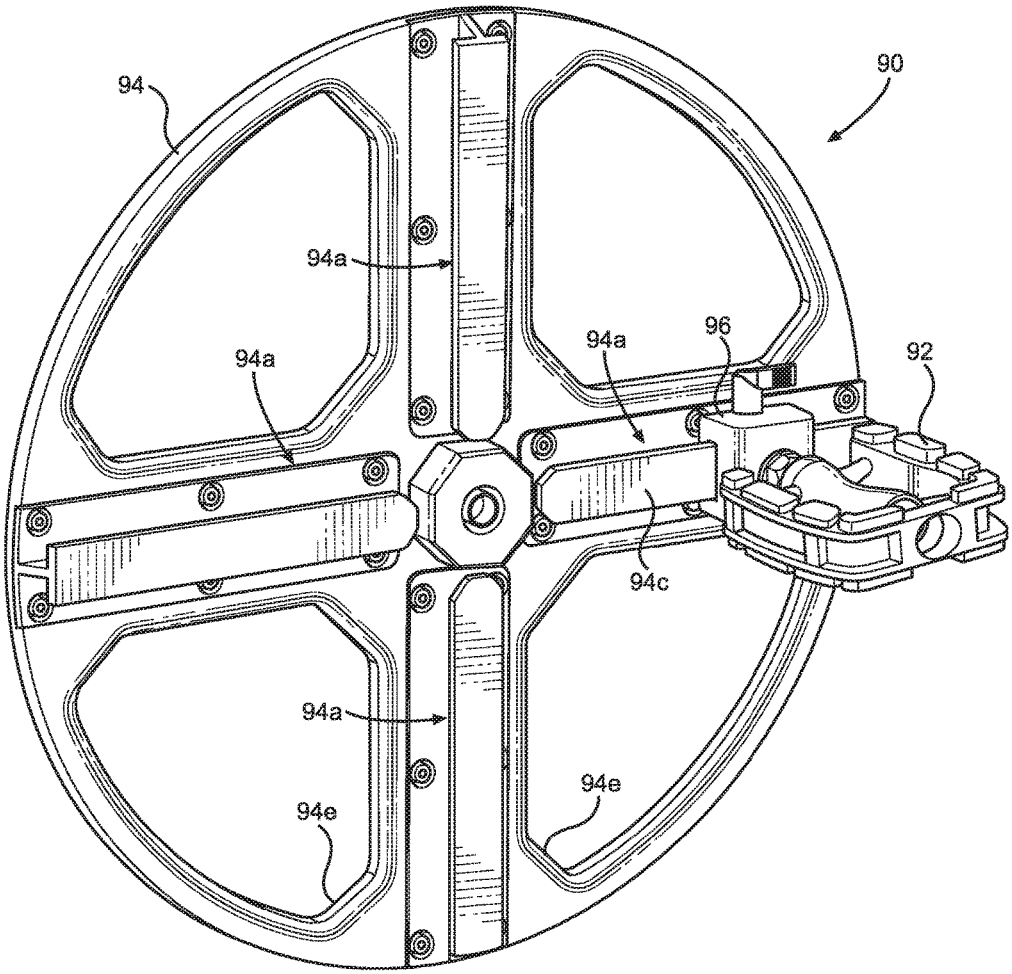
FIGS. 9A-9C, show an eighth embodiment of a wheel system for adjustably positioning a patient engagement member.
Figure 9B:
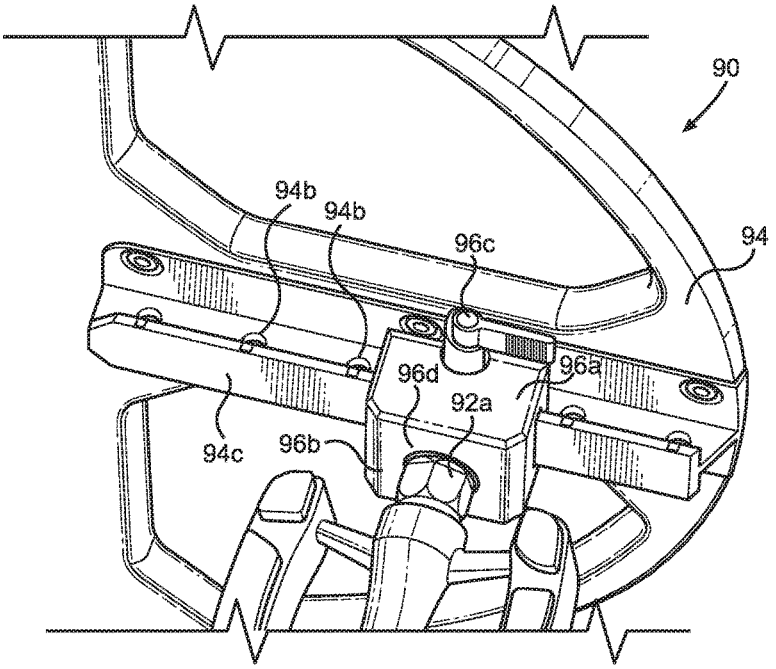
Figure 9C:
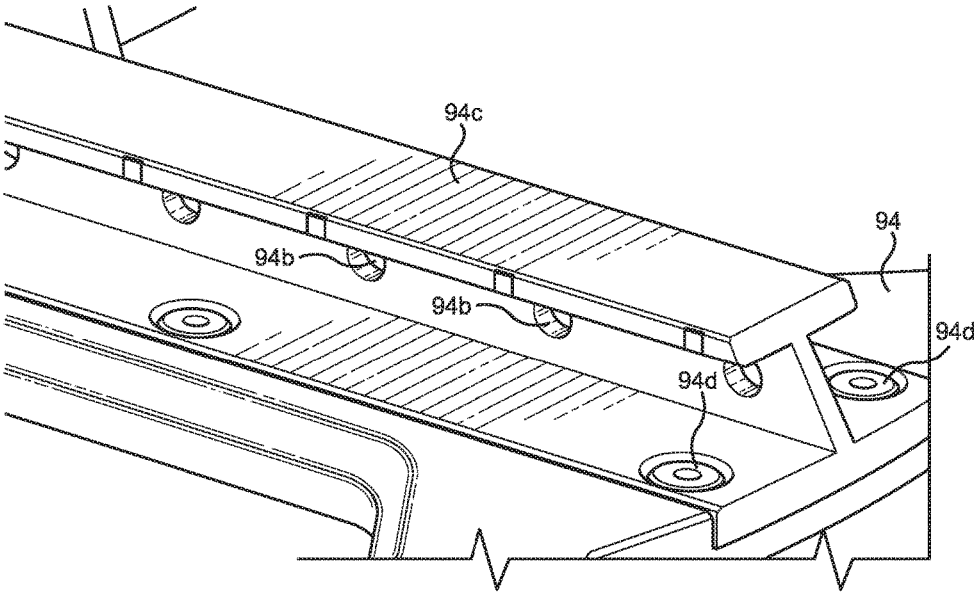

With reference to FIGS. 9A-9C, there is shown a wheel system 90 having a patient engagement member, such as a pedal 92 adjustably mounted on a wheel 94 by an adjustable mount 96.

The wheel 94 includes a plurality of spaced apart supports 94*a*. Each support 94*a* is an elongated I-shaped member having a plurality of spaced apart apertures 94*b*. The mount 96 is slidably located on an elevated rail 94*c* of the support. The supports 94*a* may be co-formed with the wheel 94, or attached thereto as by fasteners 94*d*. The wheel 94 may include open areas 94*e* to save material cost and weight.

The mount 86 is C-shaped and includes an upper portion 96*a* and a lower portion 96*b* that fit together to ride on the rail 94*c*. A lever 96*c* is located on the mount 96 to position a pin associated therewith through one of the apertures 94*c* to lock the mount 96 in place along the rail 94*c*. A receiver 96*e* is located on the mount 96 for mounting a patient engagement member, such as a pedal. For example, axle 92*a* of the pedal is screwed into the receiver 96*d*.

The mount 96 is configured to stably locate a pedal or other patient engagement member and eliminate wobble and the like associated with conventional devices. The mount 96 enables substantially incremental adjustment of the position of the mount, and hence a patient engagement member, relative to a wheel. Further, the availability of a plurality of supports 94*a* on a wheel enables a user to select which support 94*a* for installation of the mount 96. Thus, the system 90 enables radial and angular adjustment of the position of a patient engagement member. When this manner of adjustment is used for locating patient engagement members on opposite sides of the device 10, it will be appreciated that the patient engagement members, may be adjustably positioned relative to one another angularly, with each pedal being radially adjustable relative to the hubs of the wheels.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure.

The invention claimed is:

1. An adjustable rehabilitation and exercise device, comprising: a first rotary member rotatably mountable about a first hub and having a plurality of spaced apart and elongated first mount supports defined thereon; a first mount adjustably positioned on one of the first mount supports; a first patient engagement member attached to the first mount; a second rotary member rotatably mountable about a second hub the opposite the first rotary member, the second rotary member having a plurality of spaced apart and elongated second mount supports defined thereon; a second mount adjustably positioned on one of the second mount supports; and a second patient engagement member attached to the second mount, wherein the first and second mounts are adjustably positionable on the first and second rotary members to enable adjustable positioning of the first and second patient engagement members radially relative to the first and second hubs of the rotary members and angularly relative to one another; wherein the first mount supports comprise a plurality of spaced apart apertures and wherein the first mounts comprise a plate adjustably mounted to the rotary member and including an arm adjustably mounted to the plate.

2. The device of claim 1, wherein the arm comprises a pair of arms pivotally connected to one another.

3. An adjustable rehabilitation and exercise device, comprising: a rotary member rotatably mountable about a hub and having a plurality of spaced apart and elongated first mount supports defined on a first side thereof and a plurality of spaced apart and elongated second mount supports defined on an opposite second side thereof a first mount adjustably positioned on one of the first mount supports; a first patient engagement member attached to the first mount; a second mount adjustably positioned on one of the second mount supports; and a second patient engagement member attached to the second mount, wherein the first and second mounts are positionable relative to one another on the rotary member to enable adjustable positioning of the first and second patient engagement members radially relative to the hub and angularly relative to one another; wherein the first mount supports comprise a plurality of spaced apart apertures and wherein the first mounts comprise a plate adjustably mounted to the rotary member and including an arm adjustably mounted to the plate.

* * * * *